United States Patent [19]

Hanning

[11] 4,047,774

[45] Sept. 13, 1977

[54] STUDENT WORK TABLE

[75] Inventor: Michael Hanning, Oerlinghausen, Germany

[73] Assignee: Hanning-Kunststoffe Robert Hanning, Paderborn-Monkeloh, Germany

[21] Appl. No.: 617,071

[22] Filed: Sept. 26, 1975

[30] Foreign Application Priority Data

Sept. 26, 1974 Germany ..... 2445890

[51] Int. Cl.[2] ..... A47B 27/00

[52] U.S. Cl. ..... 312/231; 312/196; 312/216; 108/8

[58] Field of Search ..... 108/2, 4, 8; 312/196, 312/231, 216–220

[56] References Cited

U.S. PATENT DOCUMENTS

| | | | |
|---|---|---|---|
| 294,388 | 3/1884 | Hull | 312/196 |
| 1,652,774 | 12/1927 | Fraser et al. | 108/8 X |
| 1,897,884 | 2/1933 | Biery | 108/8 |
| 2,050,833 | 8/1936 | Fanarjian | 312/216 |
| 2,554,839 | 5/1951 | Nordmark | 312/231 |
| 2,675,288 | 4/1954 | Usher | 312/231 |
| 2,846,761 | 8/1958 | Evans | 108/8 X |

*Primary Examiner*—Paul R. Gilliam
*Assistant Examiner*—Victor N. Sakran
*Attorney, Agent, or Firm*—Stevens, Davis, Miller & Mosher

[57] ABSTRACT

A table comprises a table frame with a work surface supported thereby, two opposite sides of the work surface being provided with hinge means which enable the work surface to be selectively raised relative to the table frame about one of the two hinge means.

5 Claims, 4 Drawing Figures

STUDENT WORK TABLE

BACKGROUND OF THE INVENTION

The invention relates to a table suitable for writing and drawing, and preferably a student work table. Such a table may have an upward folding or hinged work surface and a storage compartment located thereunder. Such tables which are known from German Petty Pat. Nos. 7 125 191 and 7 125 192, Disclosure Document No. 2 253 389 as well as the Accepted Patent Document No. 2 132 626, have a work surface which is pivotably mounted at the rear edge remote from the user and can be raised into a position providing access to the storage compartment located thereunder and intended for writing instruments and the like. Moreover, this pivotable mounting is intended to provide an inclined surface for certain work with the work surface inclined from its horizontal position by lowering the front edge.

SUMMARY OF THE INVENTION

It is an object of the invention to provide a novel work table which is characterized relative to the kown construction by improvements increasing its utility value.

According to the invention, there is provided a table comprising a table frame, a work surface supported by said table frame and two hinge means at each of two opposite sides of said work surface enabling said work surface to be selectively raised relative to said table frame about one of said two hinge means.

BRIEF DESCRIPTION OF THE DRAWINGS

The invention will now be described in greater detail, by way of example, with reference to the drawings, in which:-

DESCRIPTION OF THE PREFERRED EMBODIMENT

Figure 1:
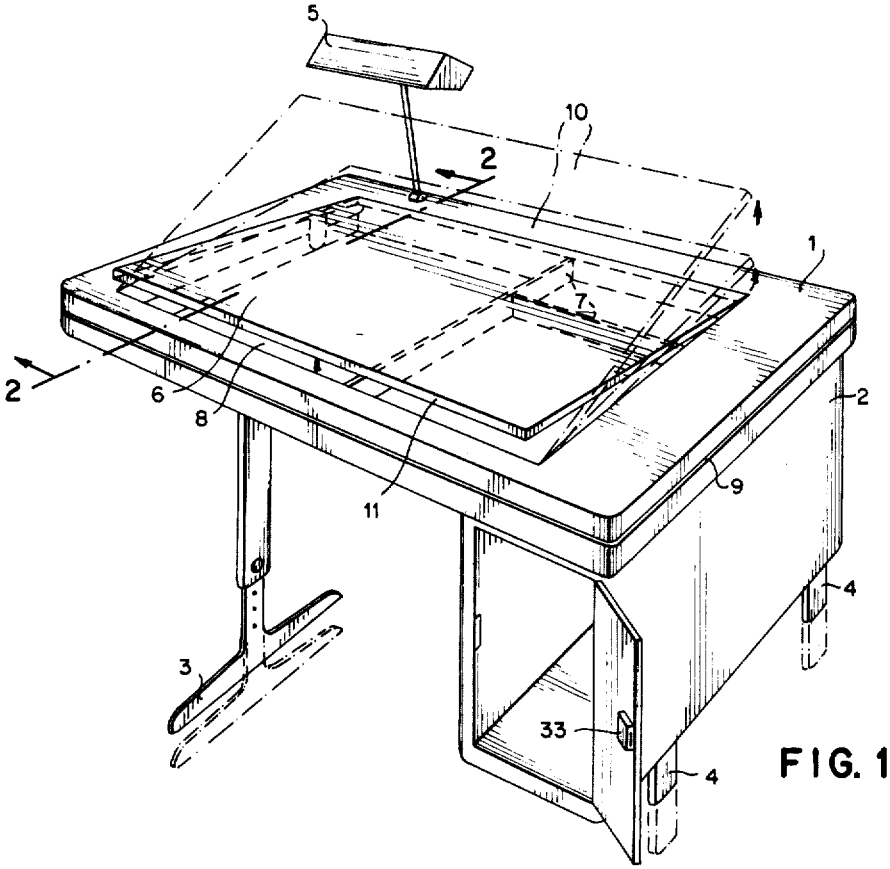
FIG. 1 is a perspective front view of a student work table constructed in accordance with the invention.

Basically the invention proposes, in a table such as that mentioned at the outset, that the work surface be pivotable, both in known manner about its rear edge remote from the user into a position making the storage compartment accessible, and, moreover, about the front edge facing the user into a variable inclined position rising towards the rear for writing or drawing. This construction provides a position for use of the work surface rising obliquely towards the rear thereof, as compared with the above-named prior art, independent of the body design of the table, and makes it possible to adapt the sloping position of the work surface optimally in each case to all requirements. Thus it is, for example appropriate to raise the work surface only to a slight extent for writing, while an oblique position can be chosen for reading in accordance with personal requirements. Further, the work surface can almost be set vertically for the preparation of drawings, similarly to a drawing board. This latter feature is a prerequisite for the fact that the student work table can further be used, at the end of school time, in professional training or during study, insofar as, at the same time, arrangements for the adaption of the table height then becoming necessary are met.

According to a further feature of the invention, a particularly simple pivotable mounting of the work surface may be achieved if the front edge and the rear edge of the work surface are supported in guide troughs, when the respective opposite edge of the work surface is raised. So that the appropriate support edge of the work surface cannot slip upwardly out of the guide trough, it may be engaged, under at its corners, by locking pins arranged fixed in the table and extending in the longitudinal direction of the guide troughs, pockets, which open towards pins and extending in each case, adjacent of the work top being provided for accommodating the respective locking pins on raising the work surface at the opposite edge. Due to these measures, tipping of the work surface out of the guide trough on one side if it should be more strongly loaded at one of the raised corners can be avoided.

Another advantageous development consists of letting the work surface into the upper side of a table plate so that is is flush therewith in its position of rest, and in providing hand-actuated means, acting on the lower side of the work top surface for raising the work surface optionally at the front edge or at the rear edge, out of the table plate. In this way, grip grooves which would otherwise indeed become necessary, but would disturb the uniformity of the table surface, become unnecessary. Particularly suitable means for the mechanical raising of the work top may be provided by the provision of at least two vertically movable lifting cams directed, in the region of the front edge of the work surface as well as in the region of the rear edge of the work surface, against their underside and a slide extending between the lifting cams and equipped with a hand grip, which slide is movable with its end available via bevelled support surfaces out of a central position assumed when the work surface is lowered to position in which bevelled support surfaces thereon are under the lifting cams to press them upwardly to raise the work surface.

The presence of a slide effecting the raising of the work surface makes an additional advantageous development of the invention possible, in accordance with which longitudinally movable hinge pins engage, at the front edge and at the rear edge of the work surface in hinge eyes mounted on the underside of the work surface and movable into this position under the action of spring elements. The hinge pins which lie at the edge of the work surface to be raised, in each case, are releasable by means of the slide acting against the force of the spring elements, to move the hinge pins out of the hinge eyes before actuation of the lifting cams. In this way, the work surface can be locked in the lowered state at both edges, whereby the storage compartment is inaccessibly closed. In order to secure it against unauthorized opening, the slide acting on the lifting cam and, if provided on the longitudinally movable hinge pins, may be made operable only from a closable cupboard part, which can be closed with lock and key, or be locked via the lock of this cupboard part. According to another variant, the means for controlling the opening operation of the work surface, particularly the hand-actuated slide, may have a lock securing it in its central position, assumed when the work surface is lowered. All these measures also appear sensible in the case of a student tabl because, according to recent psychological findings children should be able to preserve the intimacy of their own possessions. The expense in carrying out this purpose can be kept very low within the framework of the total construction chosen and can be barely noticeable in the overall production costs, particularly bearing in mind the favorable effect achieved.

For supporting the work surface in its position in which it rises obliquely to the rear, laterally resilient rests which keep the work surface in its sloping position and being optionally supported on rest edges of the side walls of the storage compartment or on the upper side of the table plate may be provided.

Referring now to the drawings, the student work table shown in FIG. 1 can be predominantly produced of plastics and in principle comprises a table plate 1, a cupboard part 2 with lock and key arranged on one side as well as a support foot 3 secured on its opposite narrow side. Two feet 4 mounted on the cupboard part 2 as well as the support foot 3 are variable with respect to length and permit the work table to be adjusted in height. In this way there is the possibility of adapting the table height to the growth of a child and to extend the useful life of the table to later professional training or to the study, if desired even up to the adult age.

The table plate 1 is equipped with a work surface 6 let into it and illuminated by an adjustable table lamp 5. Underneath the work top 6 there is a storage compartment 8 which is divided by separating walls 7 and which is suitable for the storage of writing and drawing materials, exercise books, books and the like. The larger thickness of the table plate 1 necessitated hereby is visually reduced by means of a groove 9 extending at its outer edges, in ordr not to impair the good overall style of the work table.

The work surface 6 let into the table plate 1 at the upper side and flush therewith in its position of rest is pivotable, in accordance with FIG. 1, both about its rear edge 10 remote from the user into a position which makes the storage compartment 8 accessible, and is also, for writing or drawing, pivotable about the front edge 11, facing the user, into a variable inclined position rising to the rear. In this case, the two edges 10 and 11 are supported in guide troughs 12 and 13 running parallel and visible in FIG. 2. These troughs are visible if in each case the opposite edge 10 or 11 of the work surface 6 is raised. So that the lowered edge 10 in FIG. 1 or 11 in FIG. 2 cannot rise out of the corresponding guide troughs 12 or 13 in the case of non-uniform loading of the work surface 6, the work surface 6, in its position of rest is engaged, under its corners, by locking pins serving as abutments fixed to the table and arranged in the longitudinal direction of the guide troughs 12 and 13. Pockets 15, extending, in each case, from the adjacent edge 10 or 11 of the work surface 6, open towards the locking pins 14, which pockets, as on the left-hand side of FIG. 2, accommodate the locking pins 14 when raising the work surface 6, by the pivoted movement of the work surface 6, likewise shown in FIG. 2.

Figure 2:
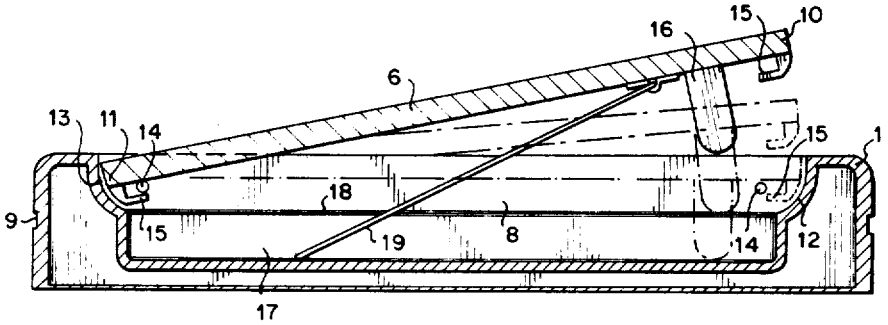
FIG. 2 is a sectional view taken on line A–B of FIG. 1 but showing the work surface, in a different position.

As further particularly follows from FIG. 2, the work surface 6 carries laterally resilient rests 16, which retain it in two different inclined positions, wherein on the one hand they are supported on an edge 18, wherein at the side walls 17 of the storage compartment 8 (possibly a plurality of such edges may be arranged one on top of the other at intervals) and, on the other hand, on the upper side of the table plate 1. If the work surface 6 is to be made steeper, as is appropriate e.g. when it is used as a drawing board, a support 19 which is swingably suspended on the lower side of the work surface and, if necessary, variable with respect to length is used.

Figure 3:
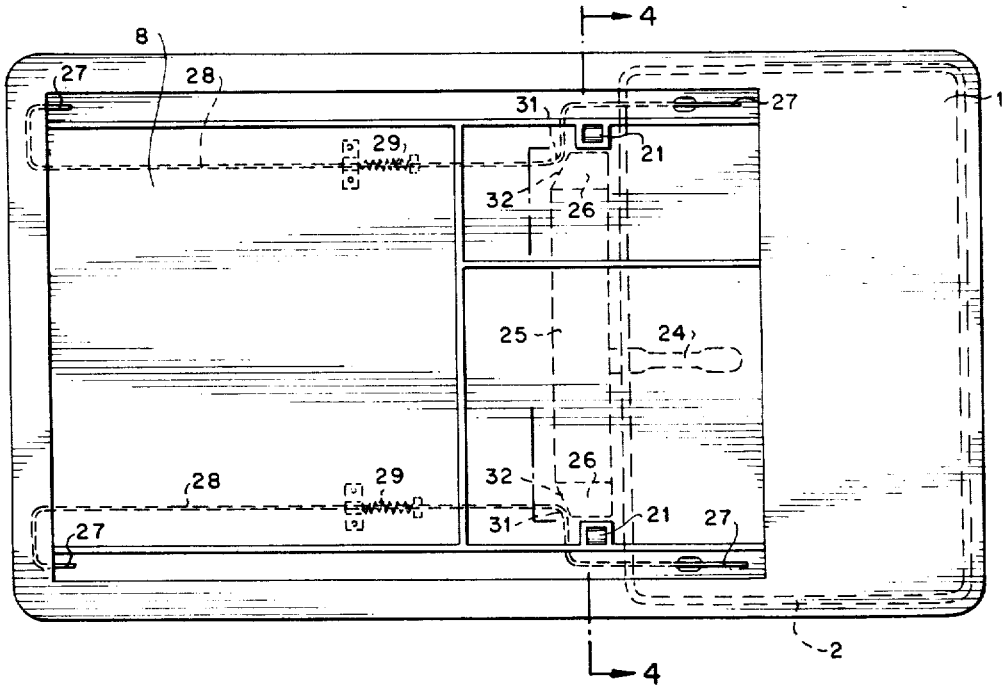
FIG. 3 shows the plan view on a table plate provided with an additional locking device for the work surface (not shown in this Figure) and FIG. 4 is a sectional view taken on the line C–D of FIG. 3.
Figure 4:
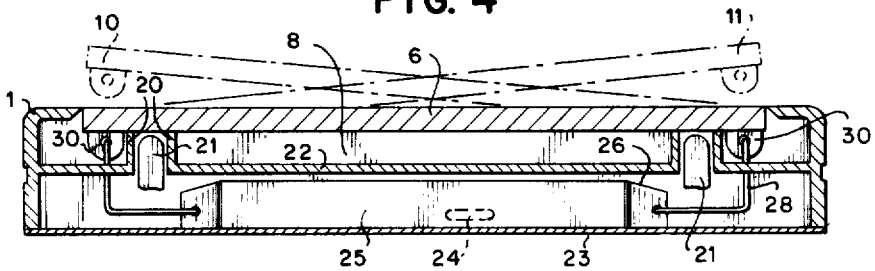

In order to be able to carry out the upward folding of the work surface 6 lying in its position of rest flush with the upper side of the table plate 1 without disturbing the uniformity of the table surface, there are provided lifting cams 21 which are shown in FIGS. 3 and 4 held at the longitudinal sides of the storage compartment 8 in vertical guides 20. They act on the underside of the work surface 6 and raise these optionally at the front edge 11 or at the rear edge 10 out of the table plate 1, if a slide which extends therebetween is guided in an intermediate space formed by the bottom 22 of the storage compartment 8 and a baseplate 23 of the table plate 1 and which is equipped with a hand grip 24. The slide has a bevelled abutting surface 26 and is moved so far under the appropriate lifting cam that it pushes the appropriate lifting cam 21 vertically upwards in its guide 20.

In the embodiment of FIGS. 3 and 4, the slide 25 simultaneously fulfills a further purpose. This is the unlocking of longitudinally movable hinge pins 27 extending along the front edge 10 and the rear edge 11 of the work surface 6. These hinge pins 27 are connected to thrust rods 28 extending underneath the storage compartment 8 and engage, under the influence of spring elements, in hinge eyes 30 which are mounted on the underside of the work surface 6 as can be seen from FIG. 4, whereby the work surface 6 is firmly locked in its rest position at both edges 10 and 11. The thrust rods abut with a bent portion 31 against oblique pressure surfaces 32 of the slide 25 so that the hinge pins 27 lying against the edge 10 or 11 of the work surface 6, to be raised, in each case, can be unlocked by means of the slide 25 moving them out of the hinge eyes 30 against the force of the spring elements 29 before the actuation of the lifting cams 21. Then the hinge pins 27 form the pivot for the hinge eyes 30 remaining in engagement therewith at the respective opposite edge 10 or 11 of the work surface 6.

The hand grip 24 mounted on the slide 25 acting on the lifting cams 21 and if necessary on the longitudinally movable hinge pins 27, should project into the cupboard part 2, so as to be accessible through an aperture in the base plate 23 (not visible). A cupboard part is provided with lock and key, which can be seen in FIG. 1 and thus can only be operable from there. In this way, until the cupboard part 2 is opened, access to handgrip 24 is prevented and with locking of the work surface 6, blocking of the storage compartment 8 in its rest position is effectively achieved so that a separate lock for the storage compartment 8 can be dispensed with. A simple central lock can also be achieved by the slide 25 being lockable via the lock 33 of the cupboard part, for which, for example, a Bowden wire can be suitable. Further, it is likewise conceivable to provide the hand-actuated slide 25 with a lock securing it in its central position assumed when the work surface 6 is lowered, which would be desirable if the cupboard part 2 does not have its own lock 33 or if separate closure possibilities should be desired.

It will be understood that the above description of the present invention is susceptible to various modification changes and adaptations.

What is claimed is:

1. An adjustable table, comprising:

a table frame having a recessed storage compartment;

a work surface movably mounted on said table frame in overlying
relation to said storage compartment;
means for alternately raising either of two opposite edge portions of said work surface, including
at least two vertically movable lifting members mounted on said table frame for urging said opposite edge portions of said work surface upward, and
a slidable member movable in opposite directions for alternately engaging said lifting members to urge the so engaged lifting member upward to thereby raise the corresponding one of said opposite work surface edge portions;
means for retaining the other of said work surface edge portions in a lowered position when said one work surface edge portion is raised, including
a pair of substantially parallel, trough-like guides locatd in said table frame, said other work surface edge portion being guided in its corresponding trough-like guide when said one work surface edge portion is raised,
a plurality of locking pins fixed to said table frame, and
a plurality of pockets mounted on said work surface adjacent said opposite edge portions, the pockets adjacent said other edge portion engaging corresponding locking pins when said one work surface edge portion is raised to thereby retain said opposite edge portion in its trough-like guide;
a plurality of hinge eyes mounted to said work surface adjacent said opposite edge portions;
at least one pair of movable hinge pins mounted on said table frame adjacent said opposite work surface edge portions for engagement with said slidable member; and
means normally biasing said movable hinge pins into engagement with said hinge eyes to prevent said opposite edge portions of said work surface from being rasied;
wherein, when said slidable member is moved in one of its opposite directions to engage a lifting member, said slidable member concurrently engages one of said pins to urge said one hinge pin out of engagement with its associated hinge eye to thereby permit said lifting member to raise said one work surface edge portion.

2. A table as defined in claim 1 further comprising a cupboard part mounted on said table frame, locking means for said cupboard part and manually operable means attached to said slide and extending into said cupboard part to prevent actuation of said slide except from within said cupboard part.

3. A table as defined in claim 2 further comprising linkage means associated with said locking means for locking said slide when said cupboard part is locked.

4. A table as defined in claim 1, further comprising laterally resilient rests mounted on said work surface for selectively supporting said work surface in raised positions on rest edges provided on the table.

5. A table as defined in claim 4 wherein one of said rest edges comprises a top of a table plate into which said work surface is let to lie flush therewith.

* * * * *